United States Patent [19]

Castellini

[11] Patent Number: 4,889,488

[45] Date of Patent: Dec. 26, 1989

[54] COMPACT APPARATUS FOR THE SUPPORT OF SUSPENDED POWER DRIVEN INSTRUMENTS, IN PARTICULAR FOR DENTAL SURGERY INSTRUMENTS

[75] Inventor: Franco Castellini, Bologna, Italy

[73] Assignee: Castellini S.p.A., Bologna, Italy

[21] Appl. No.: 161,448

[22] Filed: Feb. 18, 1988

[30] Foreign Application Priority Data

Feb. 27, 1987 [IT] Italy ..... 3364 A/87

[51] Int. Cl.[4] ..... K61C 1/06

[52] U.S. Cl. ..... 433/110

[58] Field of Search ..... 433/107, 109, 110, 112

[56] References Cited

U.S. PATENT DOCUMENTS 2,980,999 4/1961 Behne et al. ..... 433/110
3,050,855 8/1962 Ellis ..... 430/110
3,805,388 4/1974 Kato ..... 433/110

FOREIGN PATENT DOCUMENTS 1170763 4/1982 France .
2114536 8/1983 United Kingdom ..... 433/110

*Primary Examiner*—Robert Peshock
*Attorney, Agent, or Firm*—Laff, Whitesel, Conte & Saret

[57] ABSTRACT

The apparatus carries suspended power driven dental surgery instruments, and features a system whereby each arm carrying a relative instrument is split into at least two members, hinged one to the other and provided with travel limiters and a return spring mechanism, such that when the power cable of the instrument is tugged by the user, the arm will rotate by stages, with the member farthest from the table shifting before the member to which it is hinged.

6 Claims, 1 Drawing Sheet

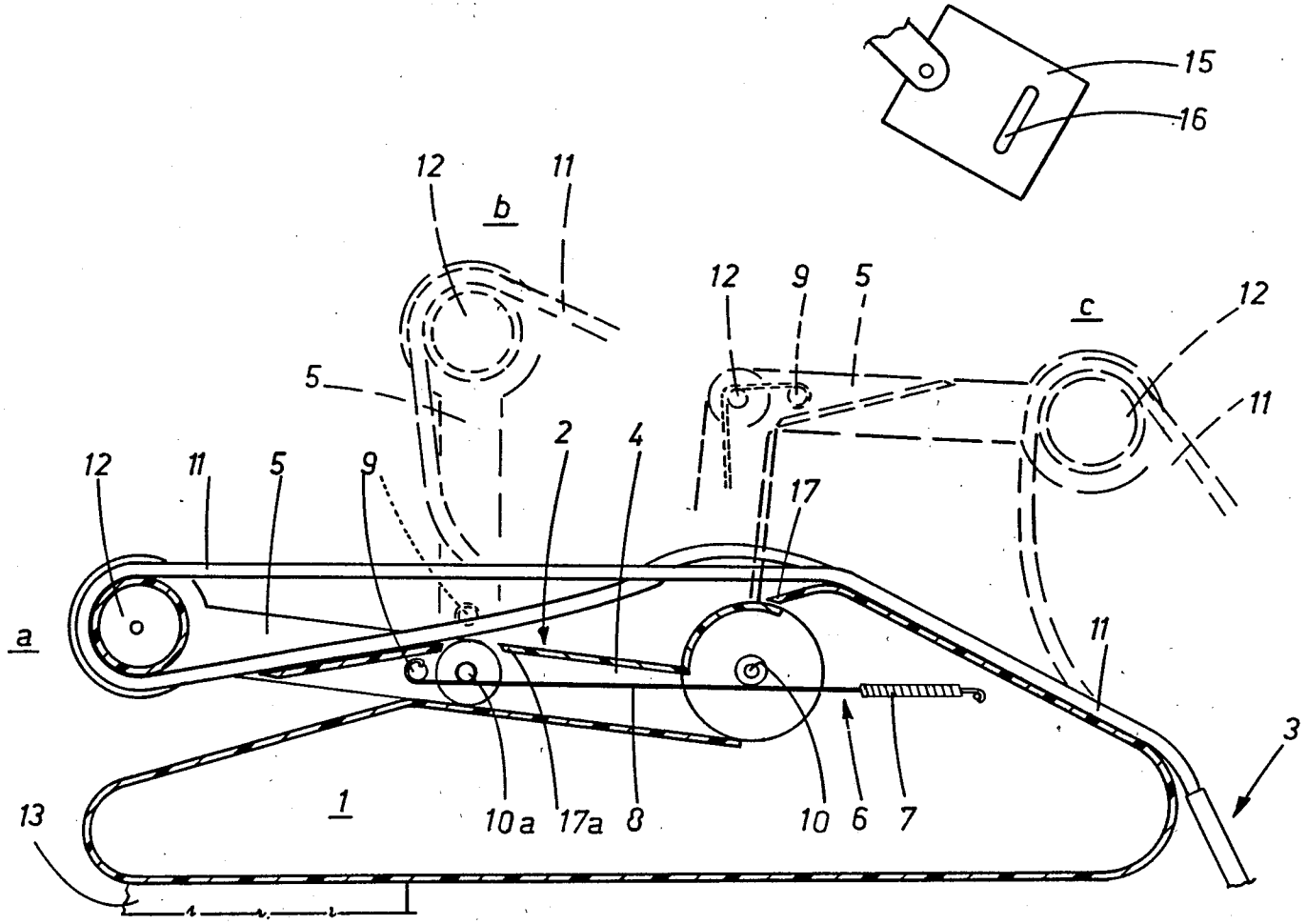
3
12
11
15
16
c
11
7
6
10
5
9
17
12
4
8
17a
2
10a
11
b
12
9
1
5
5
11
12
a
13

COMPACT APPARATUS FOR THE SUPPORT OF SUSPENDED POWER DRIVEN INSTRUMENTS, IN PARTICULAR FOR DENTAL SURGERY INSTRUMENTS

BACKGROUND OF THE INVENTION

The invention relates to a compact apparatus for the support of suspended power driven instruments, and in particular, for instruments used in dental surgery.

To provide a support medium for such suspended instruments, most manufacturers of dental surgery equipment and devices currently adopt a type of apparatus falling within a system that is generally known in Italy as S.P.R.I.D.O. (Strumenti Pendenti Recupero Inerte Doppia Operabilità, — literally: Suspended Instruments, Inert Recuperation, Dual Operability).

Such apparatus consists in a base, or table (usually associated with the equipment pedestal), and one or more arms, hinged to and projecting from the top of the table, each one of which carries a relative power driven instrument (low speed and high speed drills, syringe, scale remover etc.).

Each such arm pivots about a horizontal axis, and is subject to the action of a spring or counterpoise that balances the mass both of the instrument and of the supply cable connecting it with the table in such a way that, when the relative grip is in use, the user will be aware practically of no more weight than that of the instrument held in his/her hand.

This type of apparatus is highly practical as it enables the user to effect operations repeatedly and precisely, even with frequent changes of instrument, and without experiencing any difficulty as regards manoeuvrability of the power cable connecting the instrument with the table. In addition, apparatus of the kind in question permits a fair amount of travel to an instrument when extended toward the patient from its retracted position, stowed at the table, to the operating position; thus, the user can work more quickly and efficiently, without continually having to adjust the position of the table.

On the other hand, the arms of such apparatus reach a certain height, when extended, that can obstruct the movement and/or interfere with the field of action of other accessories, for example, the task light, generally embodied as an electric lamp carried on an articulated arm.

The problem is a delicate one, inasmuch as any accessory items such as these ought to be positioned and then left untouched, not least for reasons of hygiene.

Attempts have been made to overcome the drawback by adopting a flexible arm, that is, embodied as a spring, to replace the rigid type, though this too occupies considerable space in the height dimension, and by fitting the table with recuperator mechanisms that incorporate sliding pulleys and ways, though such arrangements are notably complex.

Accordingly, the object of the invention is that of structuring the apparatus in such a way that its overall height will not give rise to the drawback described above.

SUMMARY OF THE INVENTION

The stated object is achieved with an apparatus as disclosed and as claimed herein, in which the drawback in question is overcome by adoption of an arrangement whereby each arm is split into at least two spring-loaded, articulated members in such a way that when the relative instrument is taken up, the member farthest from the table will shift first.

One of the advantages afforded by the invention is essentially its simplicity, the result of which is that one is able to obtain a highly functional apparatus.

BRIEF DESCRIPTION OF THE DRAWING

The invention will now be described in detail, by way of example, with the aid of the accompanying drawing, which illustrates the apparatus in cross section, and with certain parts omitted for the sake of simplicity.

DESCRIPTION OF THE PREFERRED EMBODIMENT

An apparatus according to the invention comprises a base, or table 1, which is hollow and will usually be attached to the pedestal that carries the surgery equipment (not illustrated); the table 1 is rendered movable in relation to the pedestal by way of an articulated bracket 13, and is designed to carry one or more arms 2 each of which supports a relative suspended power driven instrument, or holder 3.

The instrument 3 is connected with the inside of the table 1 by way of a relative power supply cable 11, this in turn connecting with the power sources and their control media (air, water, electricity), which are not illustrated.

The cable 11 is supported by the table 1, and looped around a free pulley 12 that is mounted to the projecting end of the arm 2.

The arm 2 is capable of movement between a lowered, stowed position (illustrated in bold line) and a position in which it is raised, or at all events, extended toward the user (phantom line).

15 denotes a task light, included in the drawing for added detail, which can be adjusted manually by way of a handle 16; positioned directly over the table, such a light constitutes a typical accessory item in dental surgery equipment.

According to the invention, the arm 2 is split into at least two members 4 and 5 that are hinged one to the next about a pivot denoted 10*a*. Whilst the arm 2 is shown with two members 4 and 5 in the example of the drawing, a greater number could nonetheless be adopted, provided that the essential features of the embodiment as described below are retained.

The innermost member, i.e. lying nearest the table 1 and denoted 4, is anchored to the table by way of an offset pivot 10; more exactly, this anchor pivot 10 is offset from the longitudinal axis of the arm to a degree such that the mass of the arm 2 alone will be sufficient to keep it biased firmly into the stowed, lowered position, i.e. farthest from the user.

6 denotes tensioning means located between the outermost member 5 and the table 1 and serving to balance the instrument and assist the return of the arm 2 (rotating toward the left, as viewed in the drawing); the means 6 in question are embodied as a spring 7, anchored at one end to the table 1, and a non-extendable element 8, anchored at one end to the outermost member 5 by means of an element 9 that permits of adjusting its length, and fastened at its other end to the free end of the spring 7.

In the example shown in the drawing, the element denoted 9 is embodied as a rotatable or ratchet-controlled pin, around which the relative end of the non-extendable element 8 is wound. This adjustment facility is of particular importance, since the force exerted by the spring 7 must be sufficient to sustain the mass of the cable 11 when the instrument 3 is in use (see configuration c), and at the same time, to bias the arm 2 toward the stowed position when rotated to the left about its anchor pivot 10.

The innermost member 4 is disallowed rotation beyond a given point by a travel limiter 17 forming part of the table 1 itself; a further limiter 17*a* curbs the rotation of the outermost member 5.

With an apparatus embodied thus, it will happen that when the user takes up one of the instruments 3 and tugs on the relative cable 11, it is the outermost member 5 that rotates initially, in relation to the innermost member 4 (configuration a becomes b), following which the innermost member 4 will begin to rotate (configuration b becomes c). Assuming the two members 4 and 5 to be of the same length, therefore, the maximum height reached above the table 1 will be substantially equivalent to the length of either one of the members 4 or 5, and in any event, much less than that reached by an arm 2 embodied in one piece.

Expansion of the spring 7 is commensurate with the distance travelled by the non-extendable element 8, which wraps around the undersides of the two pivots 10 and 10*a* during the extending movement.

When the instrument 3 is released by the user, the force developed through the tensioning means 6 will be boosted initially by slight thrust generated when the cable 11 is first motioned toward the table by the user, causing the member denoted 4 to rotate first, then the member denoted 5, so that both are returned to the lowered, stowed position denoted a.

In an alternative embodiment of the arm 2, the innermost member 4 might be hinged to the table 1 at a point coinciding with its longitudinal axis, in which case it will be provided with spring means, operating independently if necessary, that invest the member 4 with a force, or at least with a bias, greater than that exerted by the spring 7.

What is claimed:

1. A compact apparatus for the support of suspended power driven instruments in particular for dental surgery instruments comprising:

a table;

at least one arm, carrying a relative suspended instrument which is hinged to the table and split into at least a first and a second member articulated consecutively one with the other and capable of movement between a retracted stowed position in which said first and second member are disposed substantially axially aligned one to each other and horizontally and parallel to said table and an extended operating position in which said first member is rotated of approximately a right angle with respect to said table and said second member is rotated approximately of a right angle with respect to said first member in the same direction; and limit means, associated with the members and/or with the table, able to limit the angle of rotation allowed to each member in relation both to the remaining member and to the table.

2. Apparatus as in claim 1, wherein the articulated members are subjected to the agency of return means in such a way that the member nearest the table is biased continually toward a lowered, stowed position by a force greater than that applied to the member next nearest the table, and that the entire arm is invested with a bias of an order, at least, such that when the instrument is in use, the user need carry a weight no more than that of the instrument proper.

3. Apparatus as in claim 2, wherein return means take the form of tensioning means designed to offset a tugging action applied to the power supply cable of the relative instrument.

4. Apparatus as in claim 3, wherein tensioning means consist in a spring, anchored to the table, and a non-extendable element made fast at one end to the spring and anchored at the remaining end to an element that permits of adjusting its length and is fastened permanently to the member of the arm farthest from the table.

5. Apparatus as in claim 1, wherein the member of the arm anchored to the table is hinged thereto about a pivot offset upwardly from the longitudinal axis of the member itself.

6. Apparatus as in claim 4, wherein the non-extendable element is located below the pivots about which the two articulated members are made to rotate.

* * * * *